United States Patent [19]

Bussmann et al.

[11] 3,959,046

[45] May 25, 1976

[54] PROCESS FOR THE AUTOMATIC CHECKING AND CONTROL OF ETCHING MACHINES

[75] Inventors: Egon Bussmann, Munich; Walter Pritzl, Munich-Unterhaching, both of Germany

[73] Assignee: Siemens Aktiengesellschaft, Berlin & Munich, Germany

[22] Filed: Jan. 30, 1974

[21] Appl. No.: 437,928

[30] Foreign Application Priority Data

Feb. 1, 1973 Germany ..... 2304933

[52] U.S. Cl. ..... 156/7; 156/345

[51] Int. Cl.[2] ..... C23F 1/02

[58] Field of Search ..... 156/7, 18, 19, 345; 73/53; 204/129.2; 340/267 R; 134/57, 58; 324/65, 71 R, 30

[56] References Cited

UNITED STATES PATENTS 3,419,446 12/1968 Benton ..... 156/345 X

*Primary Examiner*—William A. Powell

*Attorney, Agent, or Firm*—Hill, Gross, Simpson, Van Santen, Steadman, Chiara & Simpson

[57] ABSTRACT

Process and apparatus for automatic checking and control of etching machines which provides a signal related to the strength of the etching solution and provides means whereby the length of etching time can be varied in relation to the concentration of the etching solution. The present invention provides a system including a measuring compartment through which an etching solution from the etching machine is constantly circulated. A measuring wire is inserted into the measuring compartment and held stationary therein for a time sufficient to cause the etching solution to etch away an end portion of the wire. The time required to etch off this end portion is measured and provides an analog signal of etching solution strength which is proportional to etching time. This signal can be used to control the feed of the etching machine so that as the solution becomes less concentrated, the time of exposure of the material being etched is increased.

2 Claims, 4 Drawing Figures

PROCESS FOR THE AUTOMATIC CHECKING AND CONTROL OF ETCHING MACHINES

BACKGROUND OF THE INVENTION

1. Field of the Invention

This invention is in the field of continuous etching machines and is specifically directed to a control system for monitoring the etching capability of the etching solution to derive a signal which is an analog signal based upon etching solution strength. This signal may then be used for control purposes in adjusting the rate of material feed relative to the concentration of the etching solution.

2. Description of the Prior Art

During the etching of metal, for example, in the production of multi-layer wiring or etched molded components, the etching strength of the etching solution constantly decreases unless it is regenerated in a continuous process. Increased demands on the quality of the objects which are to be etched and the automation of etching processes necessitate that the period of dwell of the objects in the etching machine be precisely related to the etching strength of the etching solution.

There have been a number of processes and devices suggested for checking and controlling the etching depth in the prior art. For example, U.S. Pat. No. 3,503,817 describes a method for controlling the etching rate which involves the use of a sample test bath having a composition the same as that of the operating bath and in communication with the operating bath. In the sample test bath, a continuously moving test metal sample is continuously etched and the rate of dissolution is optically measured as a means for determining the relative strength of the etching solution.

The German Laid Open Application No. 1,521,706 describes a process in which the progress of the etching of objects passing through a spray etching device is determined at one or a plurality of measuring points by measuring the electrical conductivity of the objects, or measuring it optically, and the transport speed of the objects is appropriately adjusted.

U.S. Pat. No. 3,032,753 described an apparatus for controlling the depth of etching wherein metal strips having various thicknesses are submerged in the etching liquid. By means of two insulated electric supply lines, each metal strip is connected in series to a signal generator and a voltage source. During the etching process, the metal strips are etched through consecutively, starting with the thinnest. As soon as a metal strip has been etched through, its circuit is broken and a signal is emitted. The etching depth which has been reached can be determined from these signals.

The publication "IBM Technical Disclosure Bulletin" of June 1970, Vol. 13, No. 1, page 68, describes a process in which a check aperture is etched into the object to be etched during the etching process. The etching of the aperture is monitored by optical means with the aid of photocells and the time taken to etch through the aperture is used as a measure for the time required to complete the etching of the object.

German Utility Patent No. 71 47 646 describes a device for determining the etching strength of etching solutions in which a metallic wire is dipped into the etching solution at the exterior of the etching machine, and after etching, operates a time measuring device mechanically coupled to the wire to measure the interval of time between the submerging of the wire and the time of etching through.

German Laid Open Application No. 1,521,798 describes a process in which a conductive measuring wire is transported at a constant speed through the etching solution and the change in resistance or in the cross-section of the wire is constantly measured, and these results are used to monitor and control the process.

The monitoring and control means previously suggested have not been used extensively in practice because they have limitations in accuracy and require a considerable expenditure in terms of apparatus.

SUMMARY OF THE INVENTION

The present invention provides a means for measuring the etching strength of etching solutions with a relatively simple apparatus, and in an accurate and reliable fashion. The measurement results obtained from monitoring the etching solution may be used to control the period of dwell of the objects which are to be etched in the etching machine.

In general, the process of the present invention consists in rapidly inserting a measuring wire into a measuring compartment where it is maintained stationary and the time required to etch off an end portion of the wire is measured. This sequence is then repeated by rapidly advancing another end portion of the wire into the measuring compartment into a stationary position and determining the time required for etching off the succeeding end portion.

One of the preferred embodiments of the present invention consists in employing a measuring compartment which has a light source and a light sensitive detector, whereby when the wire is inserted between the two, circuit means are energized to initiate counting, and when the wire is etched through, the control signal is generated which is sent to a step-by-step switching unit operating in conjunction with a voltage divider. The etching strength of the solution is established in the form of an analog signal which is proportional to the etching time and can be used for controlling the feeding means of the etching machine itself.

Another form of the present invention consists in employing a measuring wire which passes through the measuring compartment and is dipped into an electrolytic solution. The etching away of the wire serves to actuate a step-by-step switching unit, the measuring wire and the electrolytic solution being part of the electric circuit in the measuring wire supply means. When the end of the wire has been etched off, the electrical circuit is broken and by means of a voltage divider connected to the step-by-step switching unit, the etching strength of the solution is determined in the form of an analog signal which is proportional to the etching time.

Another feature of the present invention resides in the use of a tube which is inserted into the etching supply line of the etching machine, with the measuring wire being conducted through the tube by means of a capillary tube which communicates with the etching solution being circulated through the tube.

Another feature of the invention resides in providing a tube which has a smaller effective diameter upstream of the measuring wire and has a larger effective diameter downstream of the wire to provide a somewhat reduced pressure in the area at which the wire is introduced into the tube.

BRIEF DESCRIPTION OF THE DRAWINGS

Other features and advantages of the invention will be readily apparent from the following description of certain perferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENTS

Figure 1:
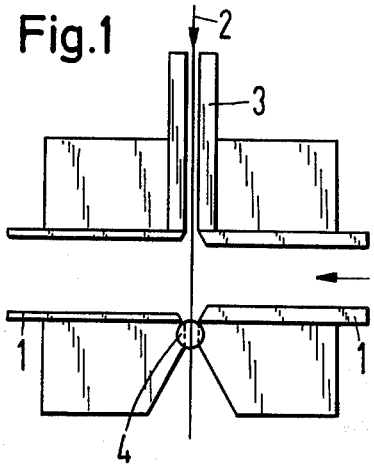
FIG. 1 is a view in elevation of a tube assembly which can be used for the purpose of the present invention.
Figure 2:
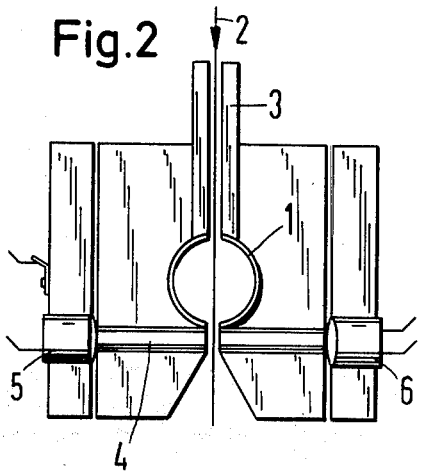
FIG. 2 is a view in elevation taken 90° from the showing in FIG. 1.

FIGS. 1 and 2 illustrate a tube 1 which may be inserted into the etching supply line of an etching machine. A measuring wire 2 is conducted into the tube 1, by means of a glass capillary tube 3. The detection means for detecting etching through of the wire 2 is located underneath the tube 1 as best illustrated in FIG. 2, and comprises a light source such as a luminescence diode 5, a glass rod 4 which is severed at the point of entry of the measuring wire 2 and a light sensitive photo-transistor 6.

The measuring of the etching strength of the solution continuously flowing through the tube 1 is carried out in the following manner. The measuring wire 2 is rapidly advanced and then maintained stationary as soon as it breaks the light barrier between the source 5 and the detector 6. When the end portion of the wire is etched off, the light path is established again so that signals corresponding to "wire present" and "wire absent" are transmitted from the photo-transistor to define the beginning and the end of the time required to etch away the end portion of the measuring wire 2.

Figure 3:
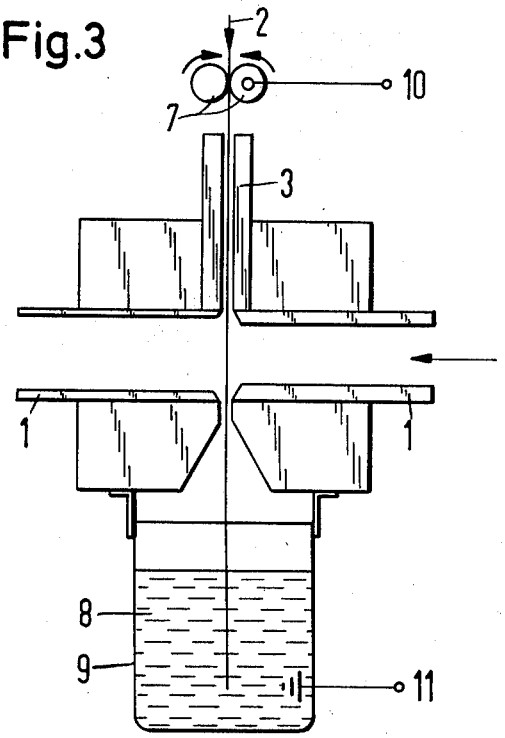
FIG. 3 is a somewhat schematic view of a modified form of the invention.

In the form of the invention shown in FIG. 3, the tube 1, the measuring wire 2 and the capillary tube 3 are of the same construction as in FIGS. 1 and 2. The supply of the measuring wire 2, however, is effected by a series of guide and contact rollers 7, and the end of the wire 2 is immersed in a container 9 filled with an electrically conducting etching solution 8. Connection terminals 10 and 11 are connected to the guide and contact rollers 7 and to the etching solution 8 so that during the etching time, an electrically conductive connection is established between the terminals 10 and 11 by means of the measuring wire 2.

Figure 4:
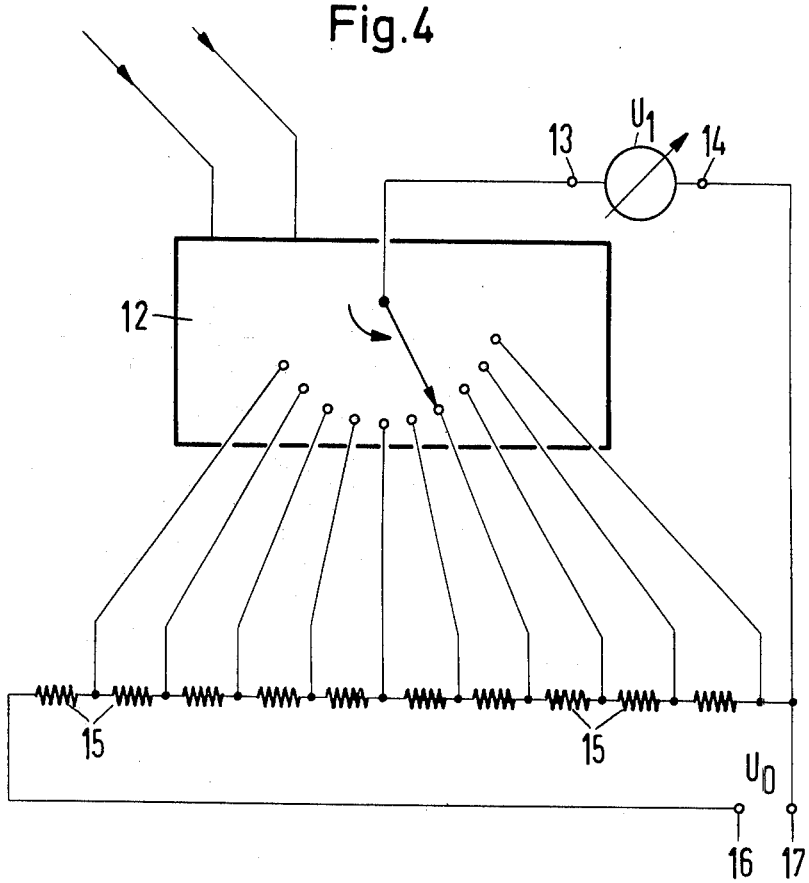
FIG. 4 is a schematic circuit diagram of a device which can be used for generating an analog signal from information supplied from the wire being etched.

FIG. 4 illustrates an arrangement for determining the etching strength in the form of an analog signal. A step-by-step switching unit 12 is shown which is actuated during the time the wire is being etched by means of a pulsed supply voltage having a low pulse repetition frequency, for example, from 1 to 2 Hertz. During the etching interval, the switching unit 12 is stepped in the direction of the arrow. The individual contacts of the step-by-step switching unit 12 are connected to a voltage divider composed of individual resistors 15 across which there is a potential applied, identified at $U_0$. The voltage occurring between the terminal 17 and the variable arm of the switching unit 12 appears at terminals 13 and 14 and is identified at $U_1$. The voltage $U_1$ is a function of the etching time and is proportional to the voltage $U_0$ applied to the terminals 16 and 17. The voltage $U_1$ is thus a measure of the etching strength of the etching solution.

The signal appearing at terminals 13 and 14 can be used to control the etching machine operation by controlling the feed rate of the material being etched. For example, if the material being etched is advanced by a suitable electric motor provided with a speed adjuster including an adjustable resistor (not shown) the automatic monitoring and control can be effected in a relatively simple fashion. A tacho-generator is coupled to the output shaft of the feed motor. By appropriately selecting the voltage $U_0$ the voltage $U_1$ can be made equal to the voltage $U_2$ which is supplied by the tacho-generator when the feed of the etching machine is correlated to the etching strength of the solution. During the control process, the voltages of $U_1$ and $U_2$ can be compared with each other by means of well known circuitry (not shown) and in the event of a difference, the speed adjusting resistor associated with the drive motor is adjusted as, for example, by means of a servo motor until the two voltages are equal. At this point, the feed velocity of the etching machine is correlated directly to the etching strength of the etching solution, the feed rate being inversely proportional to such strength.

The entire monitoring and checking cycle can be set forth in relatively simple process steps in which the sequence of the steps is determined by a programmed switching unit. These steps are as follows:

1. Advance of the measuring wire.
2. Signal "wire present".
3. Commencement of the etching time and end of the wire feed.
4. Signal "wire absent" when the etched off-wire has dropped.
5. End of the etching time.
6. Comparison of the etching time signal $U_1$ with the signal for the feed of the etching machine $U_2$.
7. Adjustment of the feed velocity of the etching machine until the signals are equal.
8. Commencement of the next monitoring and control cycle with renewed feed of the measuring wire.

It should be evident that various modifications can be made to the described embodiments without departing from the scope of the present invention.

We claim as our invention:

1. A process for checking and controlling the operation of an etching machine which comprises providing a measuring compartment, continuously circulating etching solution from said machine through said measuring compartment, rapidly advancing an end portion of a measuring wire through said measuring compartment, holding said wire in a stationary position therein, measuring the time required to etch off the end portion of said wire and thereafter sequentially rapidly advancing and holding end portions of said wire stationary for etching off succeeding end portions of said wire.

2. The process of claim 1 in which said measuring consists in generating a first electrical signal when said measuring wire enters said measuring compartment, and generating a second electrical signal when said end portion is etched off, and deriving an electrical signal dependent upon the interval between said first and second electrical signals, thereby providing an analog signal of etching solution strength which is proportional to etching time.

* * * * *